United States Patent [19]

Rischert et al.

[11] 4,005,872

[45] Feb. 1, 1977

[54] SKI-POLE GRIP HAVING RELEASABLE STRAP ATTACHMENT

[76] Inventors: Karl Rischert, Alpsteinweg 12, D-7750 Konstanz; Peter Drossler, Uhlandstr. 1, D 7972 Ismy, both of Germany

[22] Filed: Nov. 11, 1975

[21] Appl. No.: 630,855

[30] Foreign Application Priority Data

Feb. 14, 1975 Germany ..... 2506221

[52] U.S. Cl. ..... 280/11.37 H

[51] Int. Cl.² ..... A63C 11/22

[58] Field of Search ..... 280/11.37 H, 11.37 B, 280/11.37 D, 11.37 L, 11.37 F, 11.37 N, 11.37 E, 11.37 A, 11.37 K, 11.37 R

[56] References Cited

UNITED STATES PATENTS

| | | | |
|---|---|---|---|
| 2,123,437 | 7/1938 | Ring | 280/11.37 B |
| 2,445,344 | 7/1948 | Wachtel | 280/11.37 E |
| 3,378,272 | 4/1968 | Lewis | 280/11.37 H |
| 3,378,273 | 4/1968 | Lewis | 280/11.37 H |

FOREIGN PATENTS OR APPLICATIONS

| | | | |
|---|---|---|---|
| 807,790 | 7/1951 | Germany | 280/11.37 H |

*Primary Examiner*—Joseph F. Peters
*Assistant Examiner*—Milton L. Smith

[57] ABSTRACT

A ski-pole grip has a strap which is releasable therefrom in response to excessive forces acting in the direction of the pole axis. Thus the pole itself can be released from the skier in the event of a fall to reduce the chances of injury or damage. The grip has a grip portion having an end face to which one end of the strap is secured. The other end of the strap is secured to a cap portion which is adapted to cover the end face. Means are provided on the end face and in the cap portion to effect a releasable snap-on connection therebetween, there being a usable loop formed in the strap when connection is effected and the loop being opened to disengage the strap from the skier's wrist when the connection is broken.

15 Claims, 2 Drawing Figures

SKI-POLE GRIP HAVING RELEASABLE STRAP ATTACHMENT

Figure 1:
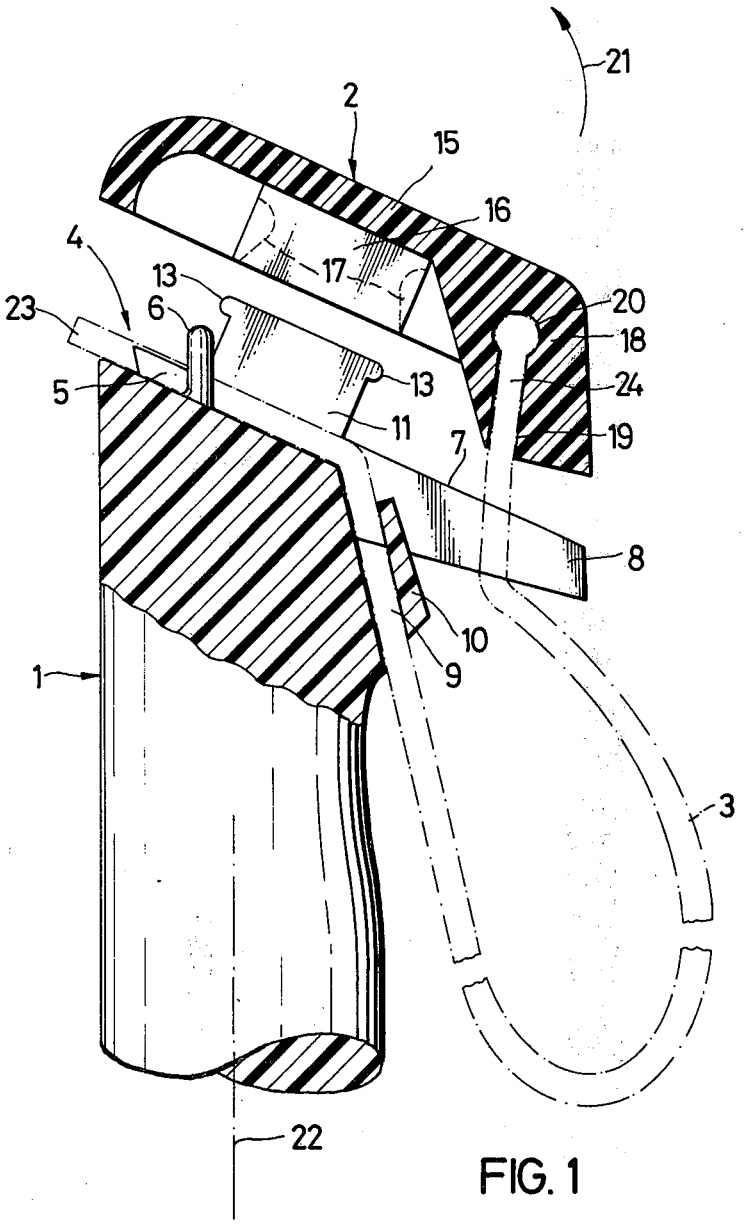

The present invention relates to a ski-pole grip having a releasable strap attachment, in which one end of the strap is secured to the ski-pole grip by a fixed attachment, while the other end is secured thereto by a releasable attachment.

It is the purpose of the invention to secure the strap to the ski-pole grip in a manner such that when a certain force is applied to the strap upwardly in the direction of the longitudinal axis of the ski-pole grip, or at a small angle thereto, at least one end of the strap is released from its attachment to the ski-pole grip and the closed loop of the strap opens.

In the event of a fall in which the ski-pole is held by an obstacle, this prevents the strap, which is looped around the skier's wrist, from holding his arm to the ski-pole and possibly injuring it. It is also intended, in the event of a fall, to prevent the ski-pole, dragged along attached to the wrist by the strap, from injuring the skier. It has been prescribed by the Technical Supervisory Association, for example, that a releasing force of 16 kilopounds must be enough to release the end of the strap from the ski-pole and thus to open the closed strap.

A releasable strap attachment of this kind, which opens under the action of a specific releasing force acting upwardly approximately in the longitudinal direction of the ski-pole grip, is already known. According to the known arrangement, one end of the strap is permanently secured to the ski-pole grip, while the other end is secured releasably to the grip by a resilient U-shaped yoke looped around a metal part of the end. The resilient, U-shaped yoke is arranged laterally at the circumference of the ski-pole grip in such a manner that a releasing force acting upwardly on the strap allows a leg of the yoke to spring open, whereas forces acting in other directions do not cause the yoke to release the free end of the strap.

This known arrangement cannot adequately protect the skier from injury. Since the resilient, U-shaped yoke at the lateral circumference of the ski-pole grip is not covered, there is a danger of injury to the fingers, especially if no gloves are being worn. Moreover the release mechanism may be damaged in a fall, so that proper release is no longer assured. There is also a danger of damage and injury when the ski-poles are being transported.

It is the purpose of the present invention to improve the releasable strap attachment of the type described above, so that the attachment is still inexpensive and easy to produce, but cannot cause injury, and is also protected against mechanical damage.

This purpose is achieved by means of a ski-pole grip comprising a grip portion having an end face, a cap portion adapted to cover the end face, a strap connected at one end to the grip portion and at the other end to the cap portion, and means on the end-face and on the cap portion to effect a releasable snap-on connection of the cap portion to the end-face.

Thus the essence of the present invention is that one end of the strap is secured to the ski-pole grip portion, while the other end thereof is secured to a covering cap portion, the cap portion having a snap-on connection with the end-face of the grip portion. The cap therefore covers the snap-on connection located between it and the end-face, and this definitely protects the release mechanism (the snap-on connection) from mechanical damage. An arrangement of this kind also has the advantage that it is impossible for snow or ice to enter, and proper release is therefore assured even under extreme weather conditions Known snap-on connections may be used for the releasable connection between the covering cap portion and the endface of the grip portion. It is essential for the snap-on connection to form, upwardly in the direction of the longitudinal axis of the ski-pole, a positive connection with a catch element in the covering cap portion, whereas a frictional connection between the catch elements is required at an angle to the longitudinal axis of the ski-pole. This ensures that a releasing force directed upwardly in the direction of th longitudinal axis of the ski-pole separates the snap-on connection between the end-face of the grip portion and the covering cap portion, whereas a force acting in any other direction cannot release the snap-on connection.

The term snap-on connection covers any arrangement capable of effecting a release when a releasing force — acting in a specific direction — exceeds a predetermined threshold. Certain over dead-center-spring designs and certain pin-sleeve arrangements possess this property. Thus the protection afforded by the present invention should cover not only the embodiment represented hereinafter (having a snap-on connection resembling a pin-sleeve connection), but also all possible connections between the end-face of the ski-pole grip portion and a cap portion covering this end-face which fulfill the conditions mentioned above.

Figure 2:
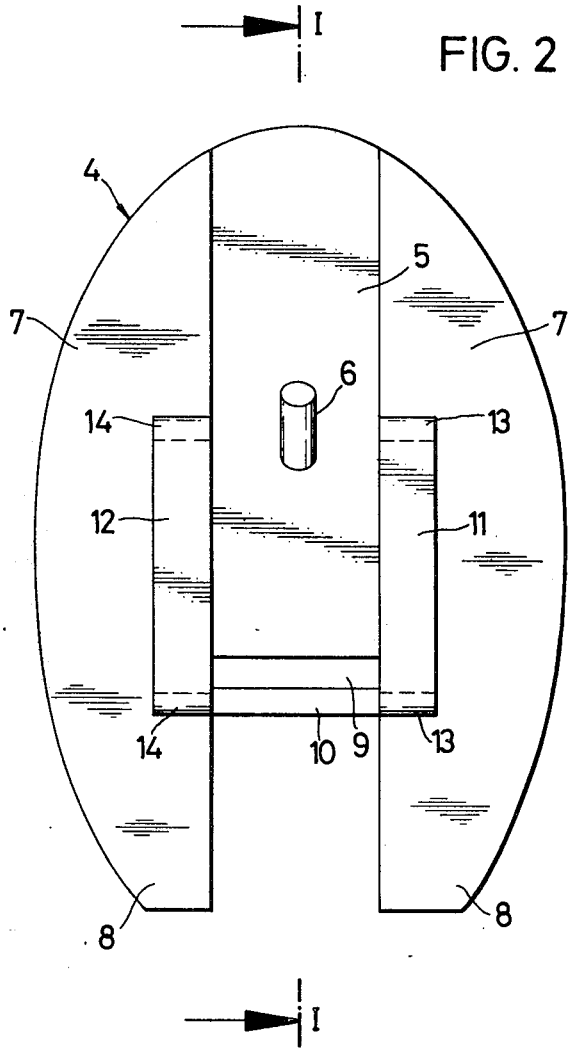

An example of the present invention is described below in conjunction with the drawings, the description and drawings also indicating additional characteristics and advantages of the present invention. In the drawings:

FIG. 1 shows a section through a ski-pole grip, according to the present invention, along the line I—I in FIG. 2; and FIG. 2 shows a plan view of the end-face of the ski-pole grip, with the covering cap omitted.

FIG. 1 shows ski-pole grip 1 in part section and broken away downwardly in the direction of longitudinal axis 22. Endface 4 of grip portion 1 slopes at an angle to the horizontal. Fixed end 23 of strap 3 is secured to end-face 4, while free end 24 of strap 3 is secured to a cap portion 2 for covering the end-face. In FIG. 1, covering cap portion 2 is shown above end-face 4 in a released condition, these two elements being connected together by a releasable snap-on connection described hereinafter in greater detail.

FIGS. 1 and 2 show the main characteristics of the catch element arranged on end-face 4 of ski-pole grip 1, which engages in associated elements located on the underside of covering cap 2. Comparison of FIGS. 1 and 2 shows that a locking plate 7 is arranged on the end-face, the locking plate having a groove 5 symmetrical with the axis of symmetry thereof (see FIG. 2), the groove accommodating the fixed end of strap 3. The attachment of the strap will be described later.

Arranged on each side of the edges of groove 5 (see FIG. 2) are locking elements 11, 12 each equipped with lugs 13, 14, and projecting from locking plate 7 (see FIG. 1).

FIG. 1 shows merely one half of the part shown in FIG. 2 and will now be described. The underside of covering cap portion 2 has locking recesses 16 associated with locking elements 11, 12, the recesses being provided with projections 17 on their narrow sides. When covering cap portion 2 is placed on end-face 4 of grip portion 1, locking elements 11, 12 engage in locking recesses 16 in covering cap portion 2, lugs 13, 14 on locking elements 11, 12 sliding on or snapping over projections 17 in locking recesses 16 and coming to rest in the terminal position (the snapped-on position), behind the projections. Thus cap portion 2 is secured releasably to end-face 4 of grip portion 1 by means of the snap-on connection described above.

A description will now be given of the attachment of strap 3 to grip portion 1, on the one hand, and to cap portion 2, on the other hand.

FIG. 1 shows the main features of the attachment of the two ends 23, 24 of strap 3. Fixed end 23 thereof is secured to end-face 4 of grip portion 1 by a pin 6, extending outwardly of the grip and arranged at the center of groove 5 (see FIG. 2). Pin 6, projecting from the surface of groove 5, passes through a selected one of many holes arranged along the longitudinal centerline of strap 3, thus holding end 23 of the strap firmly to the end-face of grip portion 1. Since pin 6 engages in one of many holes along the centerline of the strap, it is possible to adjust the length thereof. To this end, free end 23 of the strap may be lifted (with cap portion 2 removed) from pin 6 which is then allowed to pass through a different hole in the strap.

Strap 3 then passes through an opening 9 in the rearward part of grip portion 1, in a downward direction, thus forming a loop, as shown in FIG. 1. Free end 24 of the strap is secured in cap portion 2, to which end an attachment element 18 is provided at the underside of the cap. Element 18 has a groove 19 through which free end 24 of strap 3 is passed; groove 19 terminates in an enlarged recess 20 in which thickened end 24 of strap 3 is clamped.

Covering cap portion 2 is preferably secured to end-face 4 by means of a double snap-on connection. According to one preferred embodiment of the present invention, two locking elements are arranged on locking plate 7 parallel with, and spaced apart from, each other. This parallel arrangement of locking elements 11, 12 on locking plate 7 ensures that the snap-on connection has a high retaining force in the snapped-on condition. Each locking element has lugs 13, 14 at its upper end, the lugs being parallel to the longitudinal axis of the strap, and there is a similar arrangement of locking recesses on the underside of cap portion 2.

Locking elements 11, 12, arranged to be parallel and in spaced relationship with each other, have the additional advantage that the snap-on connection thus obtained is secure against rotation. Moreover, attachment element 18 in covering cap 2 lies between ends 8 of locking plate 7 in the snapped-on position, and flush against the insides of ends 8 (which are extensions of groove 5) in the assembled condition. This parallel arrangement of locking elements 11, 12, and the engagement of attachment element 18 in the gap between ends 8 of locking plate 7, prevent covering cap 2 from rotating on end-face 4 in a plane parallel with the end face.

It is characteristic of the present invention that the length of attachment element 18 in covering cap 2 exceeds the length of locking recesses 16 (as seen in the longitudinal direction). The engagement of attachment element 18 between ends 8 of locking plate 7, while the covering cap is placed with locking recesses 16 on locking elements 11, 12, guides the covering cap in a manner such that the locking recesses are always exactly above locking elements 11, 12 before the snap-on connection is made.

The parallel arrangement of locking elements 11, 12 on locking plate 7 provides an additional advantage, namely that the space between locking elements 11, 12, on each side of the line of symmetry, is in the form of the recessed groove 5 and serves to accommodate fixed end 23 of strap 3. Groove 5 is countersunk into locking plate 7 to a depth equal to the thickness of strap 3, so that the surface of the strap lies flush with the plane of locking plate 7.

When end 23 of strap 3 is placed upon pin 6 it is under comparatively little load, since the strap passes up through opening 9 (see FIG. 1) and is then bent to lie in groove 5 (see FIG. 2). In the vicinity of ends 8 of locking plate 7, opening 9 is defined by a plate portion 10 which guides the wide side of strap 3 facing ski-pole grip 1.

A characteristic of the present invention is that opening 9 and groove 19 run approximately in the direction of the centerline 22 of grip portion 1. As a result of this, strap 3 is guided in locking plate 7 completely free of tension since, in the first place, the front end of plate portion 10 absorbs the force acting upon strap 3 when this force is applied at an angle to the direction of opening 9 and, in the second place, the bend in opening 9, in relation to the plane of groove 5, absorbs all forces acting in the longitudinal direction on the strap and opening.

The arrangement of groove 19 in the longitudinal direction 22 of ski-pole grip 1, in attachment element 18, provides the substantial advantage that when covering cap 2 is lifted off strap 3 in release direction 21, any forces transferred to strap 3 in groove 19 are fully absorbed by the groove and are not transferred to recess 20 in attachment element 18, since if the snap-on connection is released in direction 21, the centerline of strap 3 forms an angle with the centerline of this groove before the entry into groove 19. Thus strap 3 is bent in relation to the axis of groove 19, so that all forces transferred by the strap to covering cap 2 are transferred by the end-face of groove 19 to the said covering cap, with no substantial load being applied to recess 20 in attachment element 18.

Still another characteristic of the invention may be gathered from FIG. 1, namely that attachment element 18 is arranged at a distance from the snap-on connection (locking recesses 16, locking elements 11, 12). The advantage of this is that a force acting upon strap 3 in the direction of release 21 has a lever arm in relation to the snap-on connection. Thus the forces transferred by strap 3 to covering cap 2 engage with the snap-on connection through a lever arm. This means that the snap-on connection may be designed so that it is rigid and shows very little wear, yet — because of the lever arm — it can be released by relatively small forces applied through strap 3 to covering cap 2. According to one preferred embodiment of the present invention, covering cap 2 is designed with a large surface area, so that the skier is protected from being injured by a narrow end-face of the ski-pole grip. The covering cap furthermore has rounded edges and is arched over the end-face of the ski-pole grip, thus still further reducing the risk of injury. Covering cap 2 therefore acts comparatively as an impact plate, the large surface thereof eliminating any danger of injury.

Since the edges of covering cap 2 lie flush with the outline of locking plate 7, and form a seal over fixed end 23 of strap 3, the snap-on connection arranged within the said covering cap is definitely protected against snow and ice, thus ensuring that the connection will release even under extreme weather conditions.

The surface of the covering cap may also be padded, in order to make ski-pole grip 1 more comfortable for the skier. According to still another embodiment of the present invention, the covering cap (shown hatched in FIG. 1) is made of a soft resilient material, whereas the snap-on connection (locking recesses 16 with projections 17) is made of a hard, strong material. Designing covering cap 2 as a soft, resilient element adds still further to the skier's comfort and to the protection from injury.

According to still another embodiment of the present invention, end-face 4 of ski-pole grip 1, and the surface of covering cap 2 associated therewith, are inclined rearwardly, at an angle to the horizontal, towards attachment element 18. This means that the surface of covering cap 2 points towards the skier, whose hand, engaging from below in strap 3, can grasp the ski-pole under the rearwardly sloping surface of the covering cap, thus facilitating the handling of the said ski-pole.

The embodiments of the invention in which an exclusive property or privilege is claimed are defined as follows:

1. A ski-pole grip comprising a grip portion having an end-face, a cap portion adapted to cover said end-face, a strap connected at one end to said grip portion and at the other end to said cap portion, and means on said end-face and on said cap portion to effect a releasable snap-on connection of said cap portion to said end face, said releasable connection means comprising a locking plate covering said end-face and two locking elements arranged parallel to and in spaced relationship with each other on said locking plate, said locking elements including lugs which, in the snapped-on condition of the connection, engage with projections in corresponding locking recesses in said cap portion.

2. A ski-pole grip according to claim 1 wherein said two locking elements are positioned symmetrically on each side of a line of symmetry of said end-face, there being a groove in said locking plate between said locking elements of a size to receive said strap.

3. A ski-pole grip according to claim 2 and including a pin extending outwardly from said groove, said pin being adapted to pass through a selected one of a plurality of holes in said one end of said strap.

4. A ski-pole grip according to claim 3 and including an opening in said grip portion adjacent one end of said groove, defined by a covering plate, and sized to receive said strap.

5. A ski-pole grip according to claim 4 and including a groove in an attachment element forming a part of said cap portion, said groove terminating in an enlarged recess adapted to receive an enlarged portion of the other end of said strap, to thereby fix the other end of said strap to said cap portion.

6. A ski-pole grip according to claim 5 wherein said groove in said attachment element and said opening in said grip portion are directed approximately parallel to the longitudinal axis of said grip portion.

7. A ski-pole grip according to claim 5 wherein said attachment element is displaced laterally from the snap-on connection between the cap portion and the end-face.

8. A ski-pole grip according to claim 5 wherein, in the snapped-on condition, said attachment element is located between rearward extensions of said locking plate.

9. A ski-pole grip according to claim 5 wherein said attachment element has a length greater than that of said locking recesses in said cap portion.

10. A ski-pole grip according to claim 1 wherein said cap portion has rounded edges and is arched over the end-face of said grip portion.

11. A ski-pole grip according to claim 1 wherein the outer surface of said cap portion is padded.

12. A ski-pole grip according to claim 1 wherein the surface of said cap portion is made of a soft, resilient material and the means for effecting the snap-on connection is made of a hard, strong material.

13. A ski-pole grip according to claim 1 wherein said endface and the surface of said cap portion are inclined rearwardly of said grip at an angle with respect to the attachment of said other end of said strap to said cap portion.

14. A ski-pole grip comprising a grip portion having an end-face, a cap portion adapted to cover said end-face, a strap connected at one end to said grip portion and at the other end to said cap portion, and means on said end-face and on said cap portion to effect a releasable snap-on connection of said cap portion to said end face, said releasable connection means comprising a locking plate covering said end face and on said locking plate locking elements each including two lugs which, in the snapped-on condition of the connection, engage with projections in corresponding locking recesses in said cap portion, said two lugs extending parallel to the longitudinal axis of said strap and being arranged in spaced relationship to each other on each of said locking elements.

15. A ski-pole grip comprising a grip portion having an end-face, a separable cap portion adapted to cover said end-face, a strap connected at one end to said grip portion and at the other end to said cap portion, and means on said end-face and on said cap portion to effect a releasable snap-on connection of said cap portion to said end face, said releasable connection means being operative to separate said cap portion from said end-face in response to application of a selected force to said strap and comprising a locking plate on said end-face and on the locking plate locking elements, said locking elements including lugs which, in the snapped-on condition of the connection, engage with projections in corresponding locking recesses in said cap portion, said cap portion covering the said locking elements.

* * * * *